United States Patent [19]

Broze et al.

[11] Patent Number: 5,057,238

[45] **Date of Patent: * Oct. 15, 1991**

[54] LIQUID LAUNDRY DETERGENT COMPOSITION CONTAINING POLYPHOSPHATE

[75] Inventors: Guy Broze, Grace Hollogne; Trazollah Ouhadi, Liege, both of Belgium

[73] Assignee: Colgate-Palmolive Co., New York, N.Y.

[ * ] Notice: The portion of the term of this patent subsequent to Jan. 24, 2006 has been disclaimed.

[21] Appl. No.: 195,248

[22] Filed: May 18, 1988

Related U.S. Application Data

[63] Continuation of Ser. No. 781,189, Sep. 25, 1985, Pat. No. 4,800,035.

[51] Int. Cl.[5] ..... C11D 7/56

[52] U.S. Cl. ..... 252/99; 252/89.1; 252/104; 252/135; 252/139; 252/153; 252/170; 252/174.16; 252/174.21; 252/174.25; 252/DIG. 14; 252/DIG. 17

[58] Field of Search ..... 252/135, 136, 89.1, 252/104, 139, 153, 170, 174.16, 174.21, 174.25, DIG. 14, DIG. 17, 99

[56] References Cited

U.S. PATENT DOCUMENTS

| | | | |
|---|---|---|---|
| 3,033,889 | 5/1962 | Chiddix et al. | 252/DIG. 1 |
| 3,630,929 | 12/1971 | van Dijk | 252/136 |
| 4,072,622 | 2/1978 | Kuhling et al. | 252/174.16 |
| 4,622,173 | 11/1986 | Broze et al. | 252/528 |
| 4,661,280 | 4/1987 | Ouhadi et al. . | |
| 4,800,035 | 1/1989 | Broze et al. | 252/99 |

*Primary Examiner*—Prince E. Willis
*Assistant Examiner*—John F. McNally
*Attorney, Agent, or Firm*—Robert C. Sullivan; Murray M. Grill; D. Nanfeldt

[57] ABSTRACT

A liquid heavy duty laundry detergent composition comprising a suspension of polyphosphate builder salt in liquid nonionic surfactant. To improve stability against settling on standing, the composition contains also a small amount of an acidic organic phosphorus compound having an acidic -POH group, such as a partial ester of phosphoric acid and an alkanol.

20 Claims, No Drawings

LIQUID LAUNDRY DETERGENT COMPOSITION CONTAINING POLYPHOSPHATE

This is a continuation of application Ser. No. 781,189, filed Sept. 25, 1985, now U.S. Pat. No. 4,800,035, issued Jan. 24, 1989.

This invention relates to liquid laundry detergent composition.

Liquid nonaqueous heavy duty laundry detergent compositions are well known in the art. For instance, compositions of that type may comprise a liquid nonionic surfactant in which are dispersed particles of a builder, such as a polyphosphate builder, as shown for instance in U.S. Pat. Nos. 4,316,812; 3,630,929; 4,264,466, and British patents Nos. 1,205,711 and 1,270,040.

It is known that such suspensions can be stabilized against settling by adding an inorganic insoluble thickening agent or dispersant of very high surface area such as finely divided silica of extremely fine particle size (e.g. of 5–100 millimicrons diameter such as sold under the name Aerosil) or the other highly voluminous inorganic carrier materials disclosed in U.S. Pat. No. 3,630,929, or by including various clays such as attapulgite, as disclosed in U.S. Pat. No. 4,264,466. Grinding to very fine particle sizes also increases the stability.

In accordance with one aspect of the invention, the stability of the suspension is increased by including therein an acidic organic phosphorus compound having an acidic - POH group. This may be, for instance, a partial ester of phosphoric acid and an alcohol such as an alkanol which has a lipophilic character, having, for instance, more than 5 carbon atoms, e.g. 8 to 20 carbon atoms. It is found that as a result of the inclusion of quite small amounts of the acidic organic phosphorus compound the suspension becomes significantly more stable against settling on standing but remains pourable. Thus, as shown below, inclusion of the acidic phosphorus compound increases the yield value of the suspension, but decreases its plastic viscosity.

It is believed that the use of the acidic phosphorus compound may result in the formation of a high energy physical bond between the -POH portion of the molecule and the surfaces of the inorganic polyphosphate builder so that these surfaces take on an organic character and become more compatible with the nonionic surfactant.

The invention is particularly suitable for use with suspensions in which the particle size of the polyphosphate builder is reduced to below about 10 microns.

The suspensions of the polyphosphate builder, such as sodium tripolyphosphate ("TPP") in the nonionic surfactant are found to behave, rheologically, substantially according to the Casson equation:

$$\sigma^{\frac{1}{2}} = \sigma_0^{\frac{1}{2}} + \eta_\infty^{\frac{1}{2}} \gamma^{\frac{1}{2}}$$

$\gamma$ is the shear rate, $\sigma$ is the shear stress, $\sigma_0$ is the yield stress (or yield value) and $\eta_\infty$ is the infinite shear rate plastic viscosity (which can be measured by determining the slope of the graph of the square root of the shear stress (as ordinate) vs. the square root of the shear rate). The yield value is the minimum shear stress below which no flow occurs (i.e., it corresponds to the intercept at the ordinate, at zero shear rate, of the graph mentioned above). It is accordingly a criterion of stability. The plastic viscosity is a measure of the flowability once the yield value has been overcome.

It is preferred that the yield value (measured at 25° C.) be at least about 2 Pascals and (for pourability and dispensability) not above about 8 Pascals, such as about 3 to 7 Pascals, more preferably about 4 Pascals.

For studying this rheological behavior, one should use a uniform, well defined shear rate viscometer (with either coaxial cylinders or cone-plate geometry) such as a Rheometrics rheometer.

The suspensions are preferably prepared by grinding a mixture of nonionic surfactant, particles of polyphosphate builder salt and the acidic organic phosphorus compound in a mill which will break down the builder particles to diameters below about 10 microns. The builder salt will generally be supplied as much larger particles of above about 40 microns diameter, such as 100, 200 or 400 microns. If desired, the builder salt may be premixed with the acidic organic phosphorus compound (e.g. by spraying the acidic compound, dispersed or dissolved in water or volatile organic solvent, onto the builder salt).

During grinding it is preferred that the proportion of solid ingredients be high enough (e.g. at least about 40% such as about 50%) that the solid particles are in contact with each other and are not substantially shielded from one another by the nonionic surfactant liquid. Mills which employ grinding balls (ball mills) or similar mobile grinding elements have given good results. Thus, one may use a laboratory batch attritor having 8 mm diameter steatite grinding balls. For larger scale work a continuously operating mill in which there are 1 mm or 1.5 mm diameter grinding balls working in a very small gap between a stator and a rotor operating at a relatively high speed (e.g. a CoBall mill) may be employed; when using such a mill it is desirable to pass the blend of nonionic surfactant and solids first through a mill which does not effect such fine grinding (e.g., a colloid mill) to reduce the particle size to less than 100 microns (e.g. to about 40 microns), prior to the step of grinding to an average particle diameter below 10 microns in the continuous ball mill.

The following Example is given to illustrate this invention further:

EXAMPLE

A nonaqueous heavy duty built liquid detergent composition is prepared by blending nonionic surfactant and sodium tripolyphosphate ("TPP") with other ingredients with and without an acidic organic phosphorus compound, as described below, and then grinding the blend in an attritor mill (to reduce the particle size of the suspended ingredients to less than 10 microns). The grinding conditions are identical in each case: grinding for ½ hour in an attritor mill containing 8 mm diameter steatite grinding balls. (Wieneroto W-1.S attritor, charged with 2.5 Kg of mixture).

| | A | B | C | D |
|---|---|---|---|---|
| Proportion of acidic organic phosphorus compound (%) | 0 | 0.1 | 0.2 | 0.3 |
| Yield stress (Pascals) | 0.3 | 1.6 | 3.2 | 5.6 |
| Plastic viscosity (Pascal seconds) | 1.1 | 1.0 | 1.0 | 0.9 |

The apparent viscosity at any shear rate can be calculated, using the Casson equation and the relationship:

apparent viscosity equals shear stress divided by shear rate.

The acidic organic phosphorus compound in this Example is a partial ester of phosphoric acid and a $C_{16}$ to $C_{18}$ alkanol (Empiphos 5632 from Marchon); it is made up of about 35% monoester and 65% diester.

The composition contains the following ingredients in the proportions specified.

35% nonionic surfactant comprising a mixture of equal parts of:

(a) a relatively water soluble nonionic surfactant which forms a gel when mixed with water at 25° C. specifically a $C_{13}$ to $C_{15}$ alkanol which has been alkoxylated to introduce 10 ethylene oxide and 5 propylene oxide units per alkanol unit and (b) a less water-soluble nonionic surfactant specifically a $C_{13}$ to $C_{15}$ alkanol which has been alkoxylated to intoduce 4 ethylene oxide and 7 propylene oxide units per alkanol unit.

12% of the reaction product prepared by mixing 100 g of succinic anhydride with 522 g. of the nonionic surfactant known as Dobanol 25-7 (the product of ethoxylation of a $C_{12}$ to $C_{15}$ alkanol, which product has about 7 ethyleneoxide units per molecule of alkanol) and 0.1 g. of pyridine (which acts as an esterification catalyst here); heating at 60° C. for 2 hours; cooling and filtering to remove unreacted succinic material (infrared analysis indicates that substantially all the free hydroxyls of the surfactant have reacted to form an acidic half ester in which the OH group of the nonionic surfactant has been esterified with one carboxyl group of the succinic anhydride).

31.5% TPP in formulation A; 31.4% in formulation B; 31.3% in C and 31.2% in D.

9% sodium perborate monohydrate, $NaBO_3 \cdot H_2O$.

4.5% tetraacetyl ethylene diamine; this is an activator for the sodium perborate 4% copolymer of about equal moles of methacrylic acid and maleic anhydride, completely neutralized to form the sodium salt thereof (Sokalan CP5); this serves to inhibit incrustation (as from formation of dicalcium phosphate).

1% diethylene diamine pentamethylene phosphonic acid sodium salt; this is a sequestering agent agent having a high stability constant for complexation.

1% proteolytic enzyme slurry (in nonionic surfactant) (Esperase)

1% mix of Na carboxymethylcellulose and hydroxymethylcellulose (an antiredepoition agent) (Relatin DM 4050)

0.5% perfume 0.5% optical brightener (of stilbene 4 type)

The TPP preferably is largely anhydrous material containing a small amount of TPP hexahydrate (e.g. an amount such that the chemically bound water content is about 3%, which corresponds to about one $H_2O$ per pentasodium tripolyphosphate molecule). Such TPP may be produced by treating anhydrous TPP with a limited amount of water. The presence of the hexahydrate slows down the rapid rate of solution of the TPP in the wash bath and inhibits caking. One suitable grade of TPP is sold under the name Thermphos NW; the particle size of this TPP as supplied is in the neighborhood of 400 microns, its phase I content is about 60%.

The mixture dispenses readily with cold water in the automatic washing machine. Its specific gravity is about 1.25 and it gives excellent washing when used at a dosage of about 100 grams per wash load (as compared with 170 grams per wash load for the usual heavy duty laundry detergent powders) in conventional European home laundry machines (which employ about 20 liters of water for the washing bath).

The partial esters of phosphoric acid are known to act as foam suppressants and are mentioned for that purpose in U.S. Pat. No. 4,264,466 (Column 33, lines 34–45). The compositions of this Example are, however, of the low-foaming type; when used to wash conventional wash loads in typical European, e.g., German, front-loading washing machines. They exhibit little foam even in the absence of the partial ester of phosphoric acid and thus do not require any foam suppressant.

The acidic organic phosphorus compound may be selected from a wide variety of materials, in addition to the partial esters of phosphoric acid and alkanols mentioned above. Thus, one may employ a partial ester of phosphoric or phosphorous acid with a mono or polyhydric alcohol such as hexylene glycol, ethylene glycol, di- or tri-ethylene glycol or higher polyethylene glycol, polypropylene glycol, glycerol, sorbitol, mono or diglycerides of fatty acids, etc. in which one, two or more of the alcoholic OH groups of the molecule may be esterified with the phosphorus acid. The alcohol may be a nonionic surfactant such as an ethoxylated or ethoxylated-propoxylated higher alkanol, higher alkyl phenol, or higher alkyl amide. The —POH group need not be bonded to the organic portion of the molecule through an ester linkage; instead it may be directly bonded to carbon (as in a phosphonic acid, such as a polystyrene in which some of the aromatic rings carry phosphonic acid or phosphinic acid groups; or an alkylphosphonic acid, such as propyl or laurylphosphonic acid) or may be connected to the carbon through other intervening linkages (such as linkages through O, S or N atoms). Preferably, the carbon:phosphorus atomic ratio in the organic phosphorus compound is at least 3:1, such as 5:1, 10:1, 20:1, 30:1 or 40:1. Among the suitable compounds are the Phosphate ester surfactants described and listed in Kirk-Othmer "Encyclopedia of Chemcial Technology", 3rd Edition, Vol. 22 (1983) Pages 359 to 361.

The particular partial alkyl ester of phosphoric acid and the $C_{16}$ to $C_{18}$ alkanol, described in the foregoing Example, is a solid which generally swells, but does not dissolve in the nonionic surfactant. It is supplied as a powder. In a preferred method, used in that Example, the TPP is added last (after the other solid ingredients have been added to the liquid blend of nonionic surfactant and reaction product of succinic anhydride and nonionic surfactant) and the powder of partial alkyl ester of phosphoric acid is added just before the TPP. Acidic organic phosphorus compounds soluble in the nonionic surfactant may also be employed.

As is well known, the nonionic surfactants are characterized by the presence of an organic hydrophobic group and an organic hydrophilic group and are typically produced by the condensation of an organic aliphatic or alkyl aromatic hydrophobic compound with ethylene oxide (hydrophilic in nature). Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxyethylene chain can be readily adjusted to achieve the desired balance between the hydrophobic and hydrophilic groups. Typical suitable nonionic surfactants are those disclosed in U.S. Pat. Nos. 4,316,812 and 3,630,929, as well as those described and listed in the discussion of nonionic surfactants in Kirk-Othmer "Encyclopedia of Chemical Technology", 3rd Edition, Vol. 22 (1983), Pages 360 to 379.

Nonionic surfactants often tend to form gels with limited amounts of cold water; this can sometimes interfere with the complete dispensing of the composition from the usual dispenser found in conventional automatic home laundry machines used in Europe. To lower the gelling temperature, and thus promote easier dispensing, there may be included in the composition a carboxylic acid anti-gelling agent. A preferred type of agent of this type is a compound having a carboxylic moiety joined to the residue of a nonionic surfactant, e.g., a half ester of succinic acid or other dicarboxylic acid in which the OH group of the nonionic surfactant has been esterified with one carboxyl group of the acid. This material is preferably in solution in nonionic surfactant.

The polyphosphate builder salt is preferably an alkali metal (e.g. Na or K) tripolyphosphate, pyrophosphate (e.g. tetrasodium pyrophosphate) or hexametaphosphate. It is preferred that these be largely in anhydrous form. Mixtures of two or more different polyphosphates may be used. The polyphosphate may also be used in admixture with one or more other water-soluble detergent builders.

Among the suitable builders are inorganic and organic builder salts such as the phosphates, carbonates, silicates, phosphonates, polyhydroxysulfonates, polycarboxylates and the like. Typical suitable builders are those disclosed in U.S. Pat. Nos. 4,316,812; 4,264,466; and 3,630,929.

Since, as indicated in the Example, the compositions of this invention may be used at relatively low dosages, it is desirable to supplement any phosphate or phosphate-forming builder (such as sodium tripolyphosphate) with an auxiliary builder such as polymeric carboxylic acid having high calcium binding capacity, in amount in the range, for instance, of about 1 to 10% of the composition, to inhibit incrustation which could otherwise be caused by formation of an insoluble calcium phosphate. Such auxiliary builders are well known in the art.

The composition preferably comprises a peroxygen bleaching agent. This may be a peroxygen compound, such as an alkali metal perborate, percarbonate or perphosphate; a particularly suitabie material is sodium perborate monohydrate. The peroxygen compound is preferably used in admixture with an activator therefor. Suitable activators are those disclosed in U.S. Pat. No. 4,264,466 or in column 1 of U.S. Pat. No. 4,430,244. Polyacylated compounds are preferred activators; among these, compounds such as tetraacetyl ethylene diamine ("TAED") and glucose pentaacetate are particularly preferred.

The activator usually interacts with the peroxygen compound to form a peroxyacid bleaching agent in the wash water. It is Preferred to include a sequestering agent of high complexing power to inhibit any undesired reaction between such peroxyacid and hydrogen peroxide in the wash solution in the presence of metal ions. Such a sequestering agent is an organic compound which is able to form a complex with $Cu^{2+}$ ions, such that the stability constant (pK) of the complexation is equal to or greater than 6, at 25° C., in water of an ionic strength of 0.1 mole/liter, pK being conventionally defined by the formula: pK=-log K where K represent the equilibrium constant. Thus, for example, the pK values for complexation of copper ion with NTA and EDTA at the stated conditions are 12.7 and 18.8, respectively. Suitable sequestering agents include the sodium salts of nitrilotriacetic acid (NTA); ethylene diamine tetraacetic acid (EDTA); diethylene triamine pentaacetic acid (DETPA); diethylene triamine pentamethylene phosphonic acid (DTPMP); and ethylene diamine tetramethylene phosphonic acid (EDITEMPA).

Other ingredients which may be included in the composition are enzymes (e.g. proteases, amylases or lipases or mixtures thereof), optical brighteners, antiredeposition agents, colorants (e.g. pigments or dyes) etc.

The composition may also contain an inorganic insoluble thickening agent or dispersant of very high surface area such as finely divided silica of extremely fine particle size (e.g. of 5–100 millimicrons diameter such as sold under the name Aerosil) or the other highly voluminous inorganic carrier materials disclosed in U.S. Pat. No. 3,630,929, in proportions of 0.1–10%, e.g. 1 to 5%. For best results it is preferable, however, that compositions which form peroxyacids in the wash bath (e.g. compositions containing peroxygen compound and activator therefor) be substantially free of such compounds and of other silicates; it has been found, for instance, that silica and silicates promote the undesired decomposition of the peroxyacid. In addition, the use of these water-insoluble inorganic materials can present other problems in the system. No voluminous silica or chain structure type clay is needed in the practice of this invention and the composition is preferably substantially free of such materials.

While in the preferred compositions the average particle size of the solids has been reduced to less than about 10 microns (e.g., typically only about 5–10% of the solids content has a particle size above 10 microns), the invention may also be applied to compositions which have not been so finely ground. It will be understood that finer grinding increases the stability of the composition against settling on standing; according to Stokes law the smaller the particle size the lower the rate of sedimentation. By raising the yield value obtained with a given degree of grinding, the use of the acidic phosphorus compound can make it possible to increase the stability of compositions in which the average particle diameter is say 15, 20, or 25 microns, as by using increased amounts of the acidic phosphorus compound to attain the desired yield value of at least about 2 Pascals.

In the compositions of the invention, typical proportions of the ingredients are as follows:

Suspended detergent builder, within the range of about 10 to 60%, such as 20 to 50%, e.g., about 25 to 40%;

Liquid phase comprising nonionic surfactant (and, optionally, dissolved carboxylic acid gel-inhibitor) within the range of about 30 to 70%, such as about 40 to 60%; this phase may also include a diluent such as a glycol, e.g., polyethylene glycol (e.g., "PEG 400") or hexylene glycol.

Carboxylic acid antigelling agent, an amount to supply in the range of about 0.5 to 10 parts (e.g., about 1 to 6 parts, such as about 2 to 5 parts) of —COOH (M.W.45) per 100 parts of the blend of such compound and the nonionic surfactant; typically the amount of this anti-gelling agent is in the range of about 0.01 to 1 part per part of nonionic surfactant, such as about 0.05 to 0.6 part, e.g. about 0.2 to 0.5 part;

Peroxygen compound (such as sodium perborate monohydrate) in the range of about 2 to 15%, such as about 4 to 10%;

Activator, in the range of about 1 to 8%, such as about 3 to 6%;

Sequestering agent of high complexing power, in the range of about $\frac{1}{4}$ to 3%, such as about $\frac{1}{2}$ to 2%;

Acidic organic —POH compound, in the range of 0.01 to 5%, such as about 0.05 to 2%, e.g., about 0.1 to 1%.

In this application all proportions are by weight unless otherwise indicated. In the Examples atmospheric pressure is used unless otherwise indicated.

It is understood that the foregoing detailed description is merely by way of illustration and that variations may be made therein without departing from the spirt of the invention.

We claim:

1. A substantially nonaqueous, low-foaming liquid heavy duty laundry detergent composition comprising a low-foaming suspension of an alkali metal polyphosphate builder salt in a liquid nonionic surfactant said composition containing an organic phosphorus compound having an acidic —POH group and which is a partial ester of an alkanol of from about 5 to 20 carbon atoms and phosphoric acid or phosphorous acid and which compound is present in effective amount to raise the yield value of said compositions.

2. A composition as in claim 1 in which said composition is has a yield value in the range of about 2 to 8 Pascals.

3. A composition as in claim 1 in which said polyphosphate salt is sodium tripolyphosphate.

4. A composition as in claim 1 in which the particle size of said suspended builder salt is less than about 10 microns.

5. A composition as in claim 1 in which the C:P atomic ration in said phosphorus compound is at least about 3:1.

6. A composition as in claim 1 in which said organic phosphorus compound is a partial ester of said alkanol and phosphoric acid.

7. A composition as in claim 1 which has been prepared by grinding said suspension until the particle size of said suspended builder salt is less than about 10 microns.

8. A composition as in claim 1 in which said composition is substantially nonaqueous and contains a peroxygen bleach.

9. A composition as in claim 8 in which said peroxygen bleach comprises sodium perborate and an activator therefor.

10. A composition as in claim 9 in which said activator is tetraacetyl ethylene diamine.

11. A composition as in claim 1 substantially free of silica and silicate thickening agent.

12. A composition as in claim 1 substantially free of chain structure type clay.

13. A composition as in claim 1 which contains a carboxylic acid anti-gelling agent.

14. A composition as in claim 13 wherein the carboxylic acid anti-gelling agent is a half ester of a dicarboxylic acid with an ethoxylated higher alkanol wherein the OH group of the alkanol is esterified with one carboxyl group of the dicarboxylic acid.

15. A composition as in claim 1 in which the organic phosphorus compound is a partial ester of phosphoric acid or phosphorous acid with an ethoxylated or ethoxylated-propoxylated higher alkanol.

16. A composition as in claim 1 in which the effective amount is in the range of about 0.01 to 5% by weight of the composition.

17. A composition as in claim 16 wherein the organic phosphorous compound is the partial ester of phosphoric acid and a $C_{16}$ to $C_{18}$ alkanol and is composed of about 35% monoester and 65% diester.

18. A built, substantially non-aqueous, low-foaming, liquid heavy duty laundry detergent composition comprising, on a weight basis, (A) from about 30 to 70% of a liquid nonionic surfactant;

(B) from about 10 to 60% of detergent builder suspended in (A), said detergent builder comprising alkali metal polyphosphate salt;

(C) from about 2 to 15% of peroxygen bleach compound;

(D) from about 1 to 8% of a bleach activator compound;

(E) from about 0.01 to 5% of an organic phosphorus compound having an acidic —POH group and which is a partial ester of phosphoric or phosphorous acid with a higher alkanol of from about 5 to 20 carbon atoms;

(F) one or more additional detergent adjuvants selected from incrustation inhibitors, enzymes, anti-redeposition agents, perfume, optical brighteners and colorants, said composition being substantially free of silica and silicate thickening agents and chain structure type clay, said organic phosphorus compound (E) raising the yield value of the composition at 25° C. to the range of from about 2 to 8 Pascals without increasing the plastic viscosity of the composition.

19. The built detergent composition of claim 20 wherein said organic phosphorus compound (E) is the partial ester of phosphoric acid and a $C_{16}$–$C_{18}$ alkanol and is composed of about 35% monoester and 65% diester.

20. A composition as in claim 1 wherein said alkanol has from about 8 to 20 carbon atoms.

* * * * *